US008113856B2

(12) United States Patent
Morrison et al.

(10) Patent No.: US 8,113,856 B2
(45) Date of Patent: Feb. 14, 2012

(54) BLOCK-OUT COVER AND REMOVAL TOOL

(75) Inventors: David Scott Morrison, Cumming, GA (US); Marc Russell Obenshain, Cumming, GA (US); Kevin Larry Nelson, Cumming, GA (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 12/949,482

(22) Filed: Nov. 18, 2010

(65) Prior Publication Data

US 2011/0065296 A1 Mar. 17, 2011

Related U.S. Application Data

(63) Continuation of application No. 12/749,961, filed on Mar. 30, 2010, now Pat. No. 7,862,365, and a continuation of application No. 12/331,523, filed on Dec. 10, 2008, now Pat. No. 7,722,378, and a continuation of application No. 11/207,853, filed on Aug. 18, 2005, now abandoned.

(60) Provisional application No. 60/603,142, filed on Aug. 19, 2004.

(51) Int. Cl.
*H01R 13/369* (2006.01)

(52) U.S. Cl. ..... 439/148

(58) Field of Classification Search ..... 439/521, 439/148, 354, 301
See application file for complete search history.

(56) References Cited

U.S. PATENT DOCUMENTS

| | | | | |
|---|---|---|---|---|
| 2,613,562 | A | 10/1952 | Clark | |
| 2,640,382 | A | 6/1953 | Grossman | |
| 3,570,096 | A | 3/1971 | Sosinski | |
| 3,935,637 | A | 2/1976 | Bunnell | |
| 3,951,514 | A | 4/1976 | Medina, Jr. | |
| 4,084,882 | A | 4/1978 | Hogan et al. | |
| 4,155,159 | A | 5/1979 | Hogan et al. | |
| 4,311,883 | A | 1/1982 | Kidney | |
| 4,380,118 | A | 4/1983 | Driver et al. | |
| 4,624,516 | A | 11/1986 | White | |
| 4,649,613 | A | 3/1987 | Bednarik | |
| 4,713,016 | A | 12/1987 | Kato | |
| 4,789,348 | A | 12/1988 | Hampton | |
| 4,887,972 | A | 12/1989 | McLean et al. | |
| 4,893,488 | A | 1/1990 | Klein | |
| 5,265,328 | A | 11/1993 | Gorman | |
| 5,305,380 | A * | 4/1994 | Hileman et al. | 379/445 |
| 5,344,329 | A | 9/1994 | Faller | |
| 5,402,562 | A | 4/1995 | Saito et al. | |

(Continued)

FOREIGN PATENT DOCUMENTS

GB 1508214 A1 4/1978

(Continued)

*Primary Examiner* — Alexander Gilman
(74) *Attorney, Agent, or Firm* — Robert A. McCann; Christopher S. Clancy

(57) ABSTRACT

A block-out cover is installed in a jack module to prevent entry of undesirable objects. The block-out cover includes at least one window and at least one locking arm. The locking arm secures the cover to the jack module. The window receives a removal tool designed to remove the cover from the jack module. The removal tool includes a body, a lever secured to the body to engage the cover and a prong with a cam surface. The cam surface of the prong deflects the cover from locking engagement with the jack module allowing the removal tool to remove the block-out cover.

16 Claims, 12 Drawing Sheets

U.S. PATENT DOCUMENTS 5,429,522 A 7/1995 Noschese et al.
5,507,666 A 4/1996 Yamanashi
5,625,943 A 5/1997 Lyonnais
5,637,002 A 6/1997 Buck et al.
5,984,705 A 11/1999 Miyazaki et al.
6,006,422 A 12/1999 Hickox
6,227,717 B1 5/2001 Ott et al.
6,309,247 B1 * 10/2001 Wang ..... 439/521
6,634,096 B1 10/2003 Yamamoto et al.
6,817,089 B2 11/2004 Whitehead
6,913,393 B2 7/2005 Buck et al.
7,354,291 B2 4/2008 Caveney et al.
7,438,584 B2 10/2008 Caveney et al.
2002/0150372 A1 10/2002 Schray
2006/0040564 A1 2/2006 Morrison et al.
2009/0004904 A1 1/2009 Caveney et al.
2009/0007609 A1 1/2009 Obenshain
2009/0047818 A1 2/2009 Irwin et al.
2009/0088027 A1 4/2009 Morrison et al.

FOREIGN PATENT DOCUMENTS

WO 03028166 A1 4/2003

* cited by examiner

BLOCK-OUT COVER AND REMOVAL TOOL

CROSS REFERENCE TO RELATED APPLICATION

This application is a continuation of U.S. application Ser. No. 12,749,961, filed Mar. 30, 2010, which is a continuation of U.S. application Ser. No. 12/331,523, filed Dec. 10, 2008, now U.S. Pat. No. 7,722,378, issued May 25, 2010, which is a continuation of U.S. application Ser. No. 11/207,853, filed Aug. 18, 2005, which claims priority from U.S. Provisional Application Ser. No. 60/603,142, filed Aug. 19, 2004, the entire disclosure of which is hereby incorporated by reference.

FIELD OF THE INVENTION

The present invention relates to a cover for a jack module, and more particularly, to a tool for removing the cover from the jack module.

BACKGROUND OF THE INVENTION

Dust covers, also known as block-out covers, are frequently inserted into jack modules to protect the module and prevent entry of undesirable objects. Some covers include multiple parts or special latch connectors that secure the cover to the modules. Other covers have relatively large open areas designed to receive a flat tool that would enable the end user to release the cover from the module so that it could be removed from the module. The covers with the larger open areas, however, may be accidentally removed from the module.

There are also covers that are inserted in the opening of a module and then locked by a rotating key. These covers may only be removed by inserting the key and rotating it to unlock or release the cover from the module. Thus, it is desirable to provide an improved cover and removal tool where the cover would not be accidentally removed from a module but would be easily removed from the module by a simple tool.

SUMMARY OF THE INVENTION

The present invention is directed to a cover for a jack module and a tool for removing the cover from the jack module. The cover has at least one locking arm disposed within the cover for securing the cover to the jack module. The cover also has at least one window designed to receive the removal tool. The tool has a body, a lever secured to the body and prongs extending from the body. The prongs have a cam surface that deflects the cover from locking engagement with the jack module when the tool is inserted in the window in the cover. The lever engages the cover when the tool is inserted into the cover thereby enabling the tool to remove the disengaged cover from the jack module.

DETAILED DESCRIPTION

Figure 1:
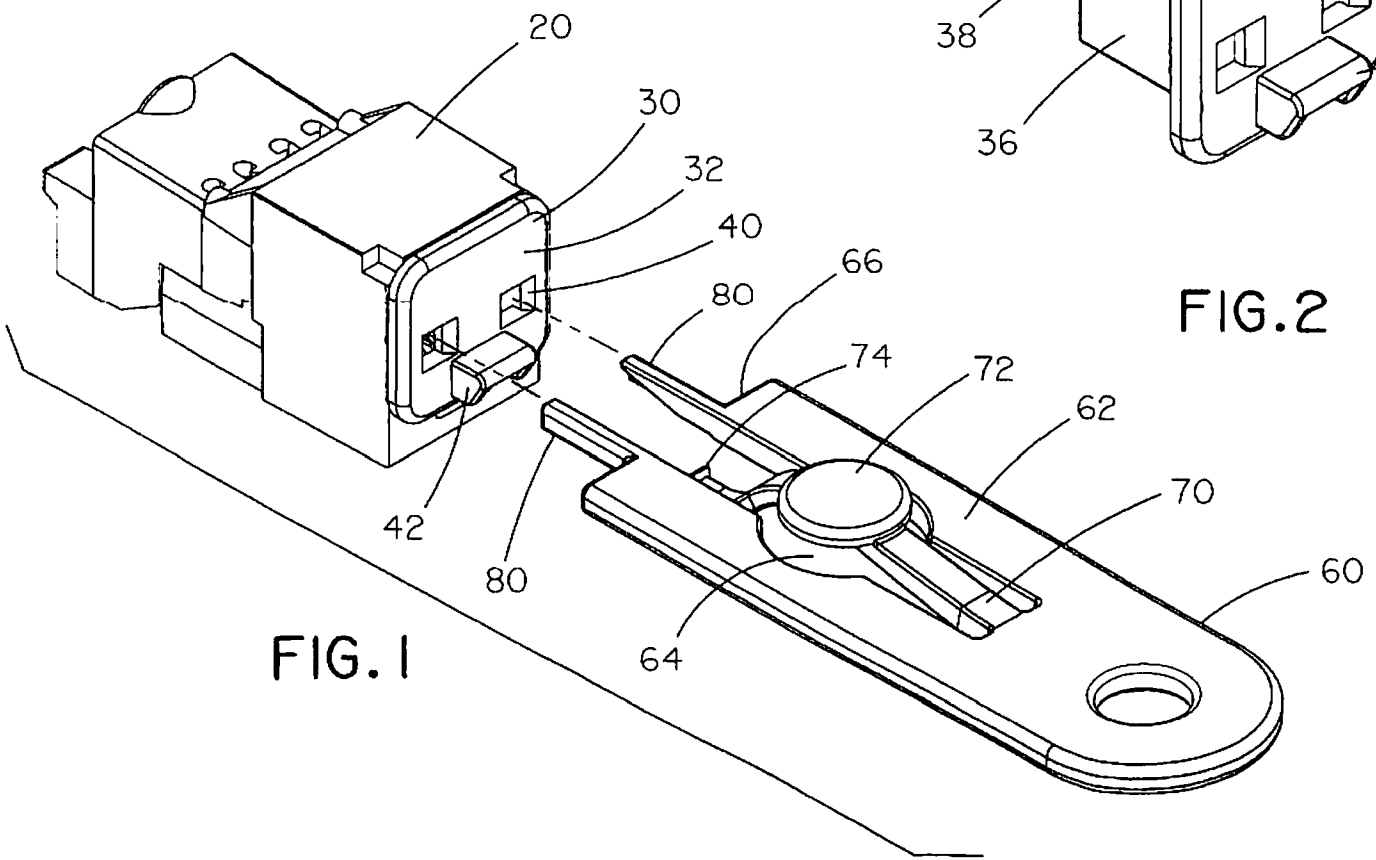
FIG. 1 illustrates a perspective view of a block-out cover installed in a jack module and a block-out removal tool of the present invention.

FIG. 1 illustrates the removal tool 60 and the block-out cover 30 installed in a jack module 20 of the present invention. As described below, the removal tool is designed to remove the block-out cover from the jack module by simply inserting the tool into the cover until the tool is attached to the cover. Next, the tool and attached cover are simply pulled out of the module.

Figure 2:
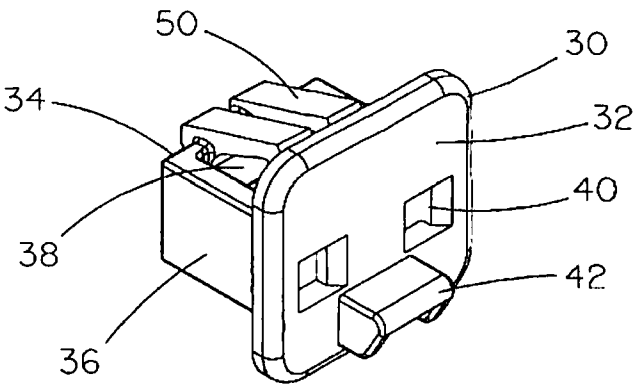
FIG. 2 illustrates a top front perspective view of the block-out cover illustrated in FIG. 1.
Figure 3:
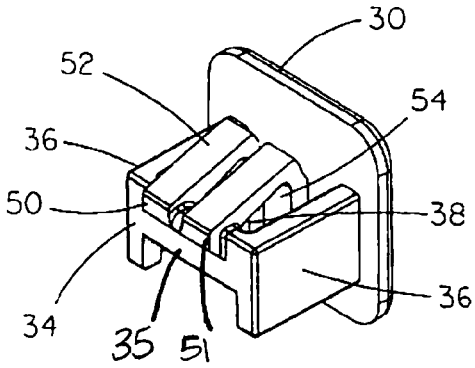
FIG. 3 illustrates a top rear perspective view of the block-out cover illustrated in FIG. 1.
Figure 4:
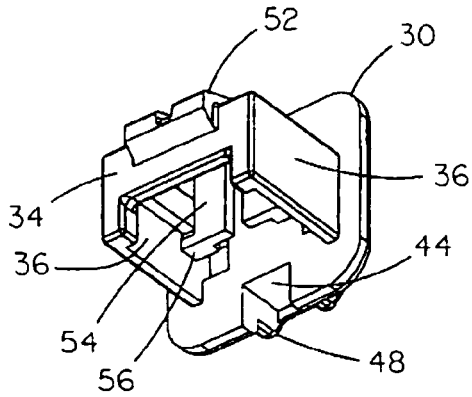
FIG. 4 illustrates a bottom rear perspective view of the block-out cover illustrated in FIG. 1.

As shown in FIGS. 2-4, the block-out cover 30 includes a front 32, back 34 and sides 36 that define an open center section 38 therebetween. The front 32 of the block-out cover includes two access windows 40, as shown in FIG. 2. The access windows 40 receive the prongs 80 of the removal tool 60. The access windows 40 have a rectangular shape. However, the access windows may be formed from various shapes as long as the prongs 80 of the removal tool 60 are able to enter and be disposed therein.

Figure 8:
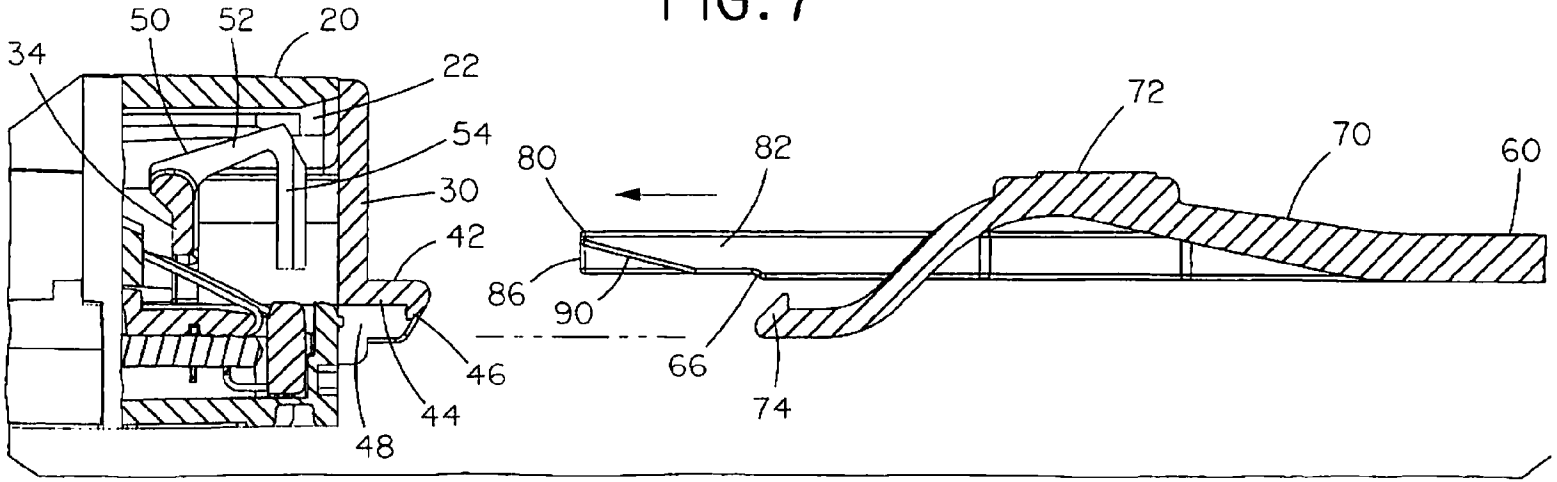
FIG. 8 illustrates a cross sectional view of the block-out cover and the removal tool taken along line 8-8 in FIG. 7.

The front 32 of the block-out cover 30 also includes a connection member 42 that is positioned below the access windows 40 preferably at the center of the cover. The connection member 42 is integrally formed with the cover. The connection member 42 includes a top portion 44 extending from the cover, a downwardly facing hook 46 and sides 48, as illustrated in FIG. 8. The hook 46 extends downward from the top portion 44 and the sides 48 surround the hook 46. As will be described below, the hook 46 engages a hook 74 extending from the release lever 70 of the removal tool 60 to secure the removal tool 60 to the block-out cover 30.

FIGS. 2-4 also illustrate the block-out cover 30 with locking arms 50 disposed in the open center section 38 of the block-out cover 30. The arms 50 are integrally formed with the block-out cover 30 such that the arms 50 extend from the back 34 of the cover 30 into the open center section 38. The arms 50 comprise first portions 51, second portions or upwardly extending members 52 and third portions or downwardly extending members 54. As shown in FIG. 8, a portion of back 34 and arms 50 may form a generally U-shaped profile. Back 34 may comprise bar member 35 connecting the opposing sides 36 of the cover 30, with an open space beneath bar member 35 such that back 34 is open ended. Additionally, each downwardly extending member 54 has a flange 56 that extends outwardly towards the sides 36 of the cover 30. The upwardly extending members 52 enable the cover 30 to be secured inside the jack module 20, as illustrated in FIG. 8. As will be described below, the flanges 56 of the downwardly extending members 54 are deflected to enable the removal tool 60 to disengage the upwardly extending members 52 of the arms 50 from the jack module 20.

Figure 5:
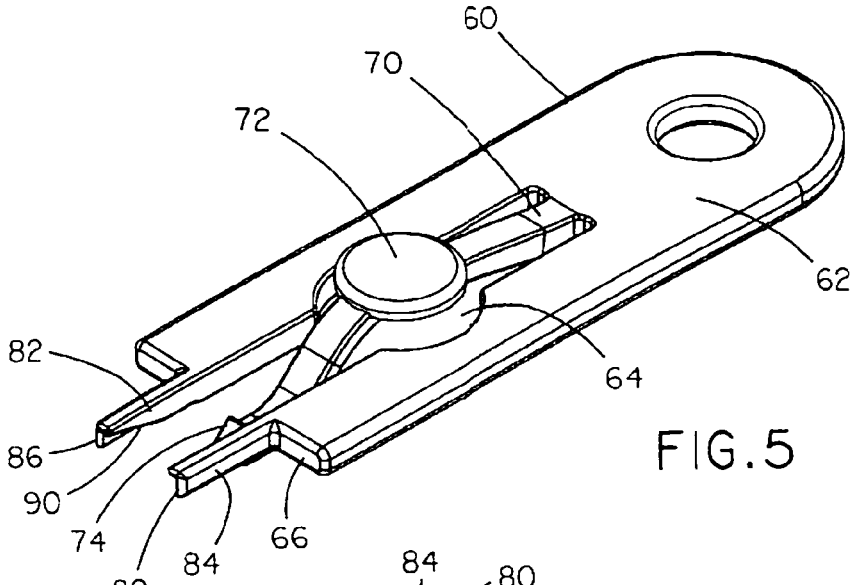
FIG. 5 illustrates a top perspective view of the removal tool illustrated in FIG. 1.
Figure 6:
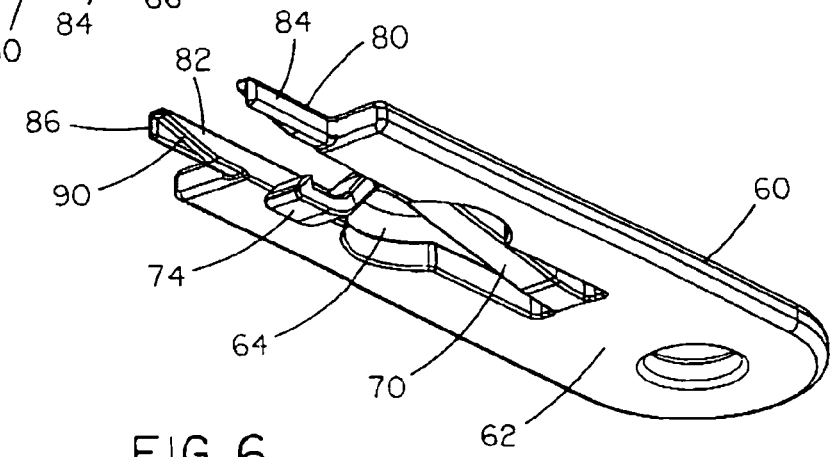
FIG. 6 illustrates a bottom perspective view of the removal tool illustrated in FIG. 1.

FIGS. 5 and 6 illustrate the removal tool 60 of the present invention. The removal tool 60 has a partial oblong shaped body 62 that is easy to handle. The removal tool 60, however, may be formed from a variety of shapes, as desired. The body 62 of the removal tool 60 includes an opening 64 in the center of the body and a front edge 66. A release lever 70 is positioned within the opening 64 at the center of the removal tool 60. The release lever 70 is integrally formed with the removal tool. The release lever 70 includes a raised knob 72 located near the center of the lever and an upwardly facing hook 74 located at the free end of the lever. As will be described with respect to FIGS. 15 and 16, when the end user pushes the raised knob 72 downwards the hook 74 at the free end of the lever also moves downwards.

The removal tool 60 also includes two prongs 80 that extend from the front edge 66 of the tool 60. One of the prongs 80 is preferably positioned on either side of the release lever 70. Each of the prongs 80 includes an inner side 82, an outer side 84 and a front end 86. The prongs 80 include a ramp shaped cam 90 located on the inner side 82 of each prong 80. The ramp shaped cams 90 extend from the front end 86 of each prong 80 downward towards the front edge 66 of the tool 60. The ramp shaped cams 90 are designed to engage the flanges 56 of the downwardly extending members 54 of the arms 50 when the tool 60 is inserted in the block-out cover 30.

Figure 7:
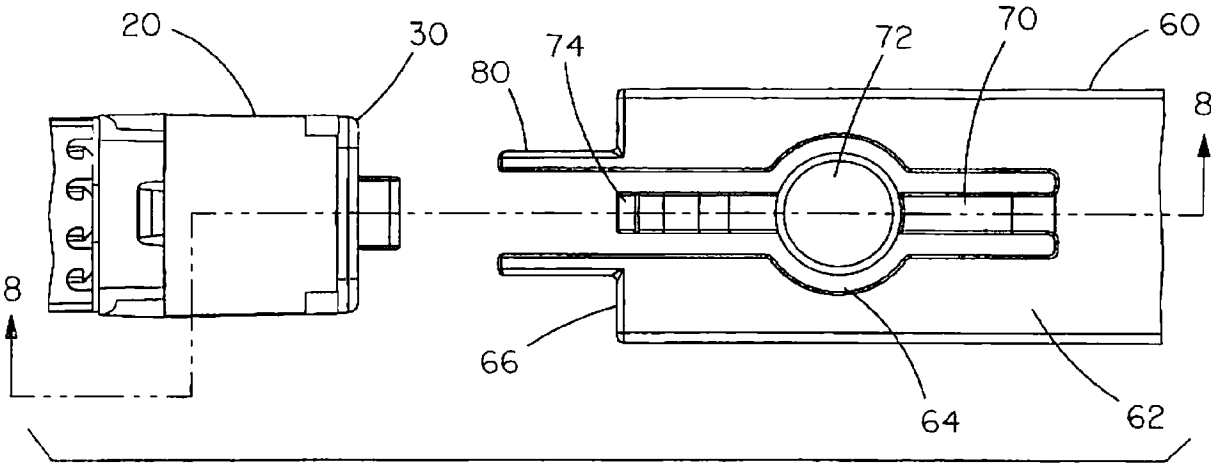
FIG. 7 illustrates a top plan view of the block-out cover installed in the jack module and the block-out removal tool illustrated in FIG. 1.

As shown in FIGS. 7 and 8, when it is desirable to remove the block-out cover 30 from the jack module 20, the removal tool 60 is positioned such that the prongs 80 are aligned with the access windows 40 in the front of the block-out cover 30 and the lever 70 of the removal tool 60 is aligned with the connection member 42 extending from the front of the block-out cover 30.

Figure 9:
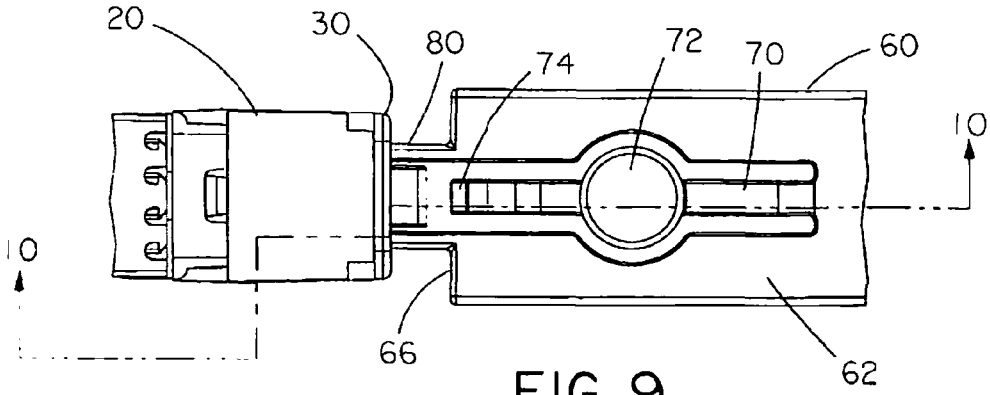
FIG. 9 illustrates a perspective view of the removal tool partially inserted in the block-out cover installed in the jack module illustrated in FIG. 1.
Figure 10:
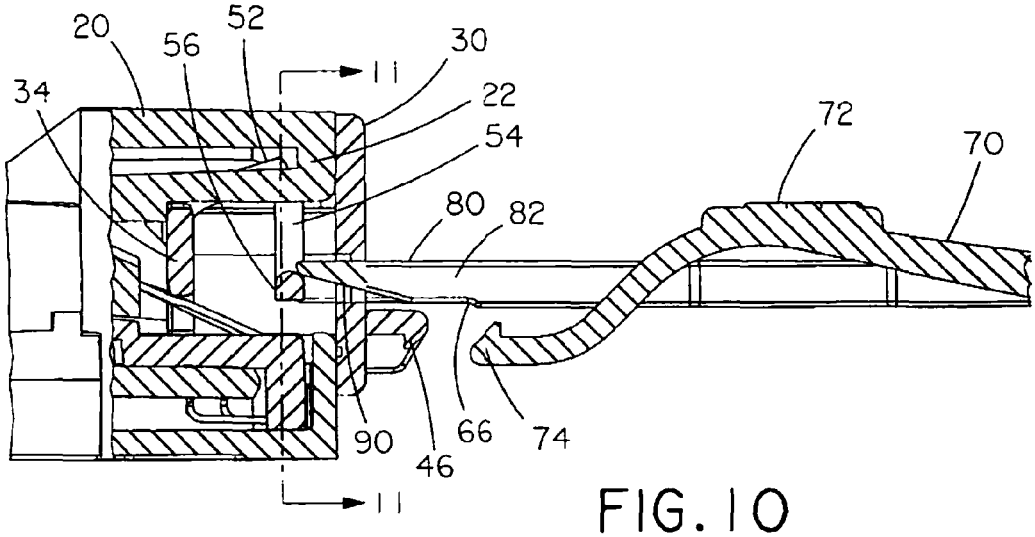
FIG. 10 illustrates a cross sectional view of the removal tool partially inserted in the block-out cover installed in the jack module taken along line 10-10 in FIG. 9.
Figure 11:
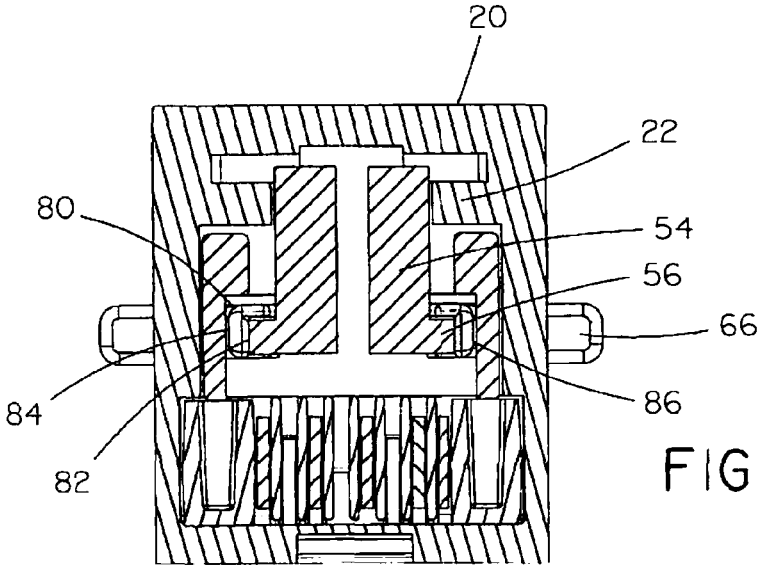
FIG. 11 illustrates a front cross sectional view of the block-out cover installed in the jack module taken along line 11-11 in FIG. 10.

FIGS. 9 and 10 illustrate the removal tool 60 being partially inserted in the block-out cover 30. As the prongs 80 of the removal tool 60 enter the access windows 40 in the block-out cover 30, the ramp shaped cams 90 engage the flanges 56 of the downwardly extending members 54 of the arms 50. As shown in FIG. 11, the upwardly extending members 52 of the arms 50 of the block-out cover 30 engage an upper shelf 22 in the jack module 20 to maintain the block-out cover 30 in the jack module 20. However, as the ramp shaped cams 90 engage the flanges 56 of the downwardly extending members 54, the upwardly extending members 52 of the arms 50 are deflected away from the upper shelf 22 of the jack module 20.

Figure 12:
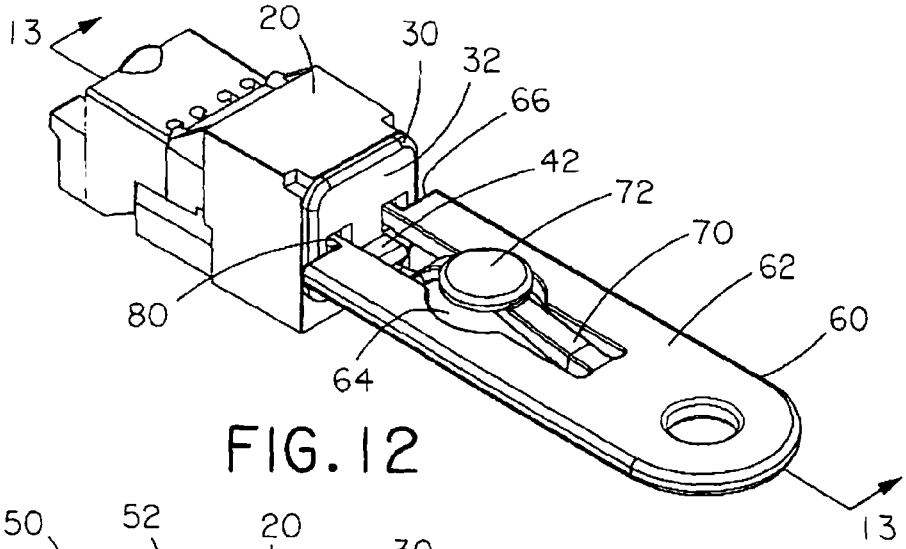
FIG. 12 illustrates a perspective view of the removal tool inserted in the block-out cover installed in the jack module illustrated in FIG. 1.
Figure 13:
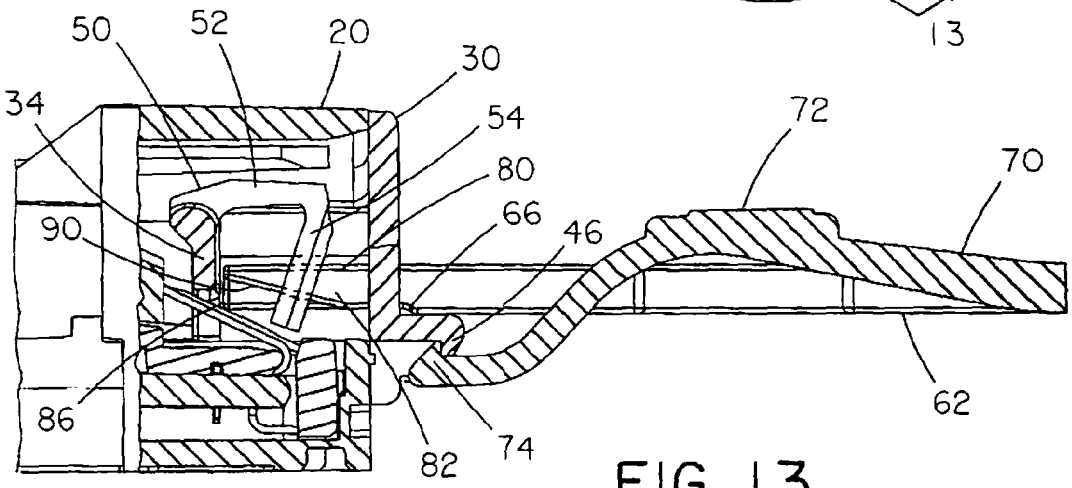
FIG. 13 illustrates a cross sectional view of the removal tool inserted in the block-out cover installed in the jack module taken along line 13-13 in FIG. 12.

FIGS. 12 and 13 illustrate the removal tool 60 fully inserted into the block-out cover 30. As illustrated in FIG. 13, the ramp shaped cams 90 have deflected the arms 50 downwardly and back towards the back 34 of the cover 30. As a result, the upwardly extending members 52 of the arms 50 no longer engage the upper shelf 22 of the jack module 20. Since the arms 50 have been disengaged from the jack module 20, the block-out cover 30 may be removed from the jack module 20.

Figure 14:
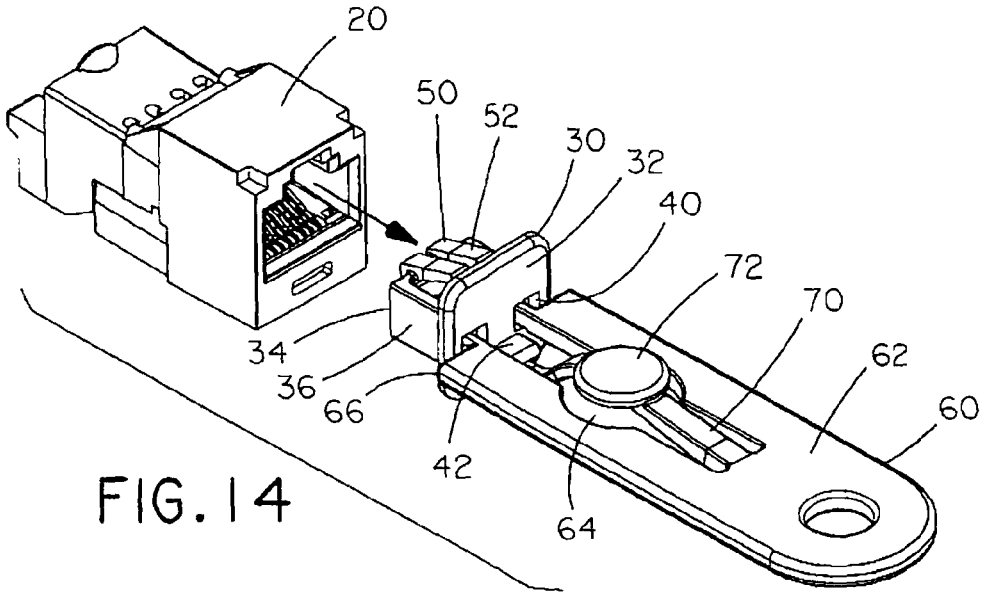
FIG. 14 illustrates the removal tool removing the block-out cover from the jack module illustrated in FIG. 1.

FIGS. 12 and 13 also illustrate that once the tool 60 has been inserted in the cover 30, the hook 74 at the free end of the lever 70 snaps into engagement with the hook 46 extending from the connection member 42 of the cover 30. Thus, the removal tool 60 is secured to the block-out cover 30. As illustrated in FIG. 14, after the removal tool 60 has been inserted and secured to the block-out cover 30, the removal tool 60 and connected block-out cover 30 may be easily removed from the jack module 20.

Figure 15:
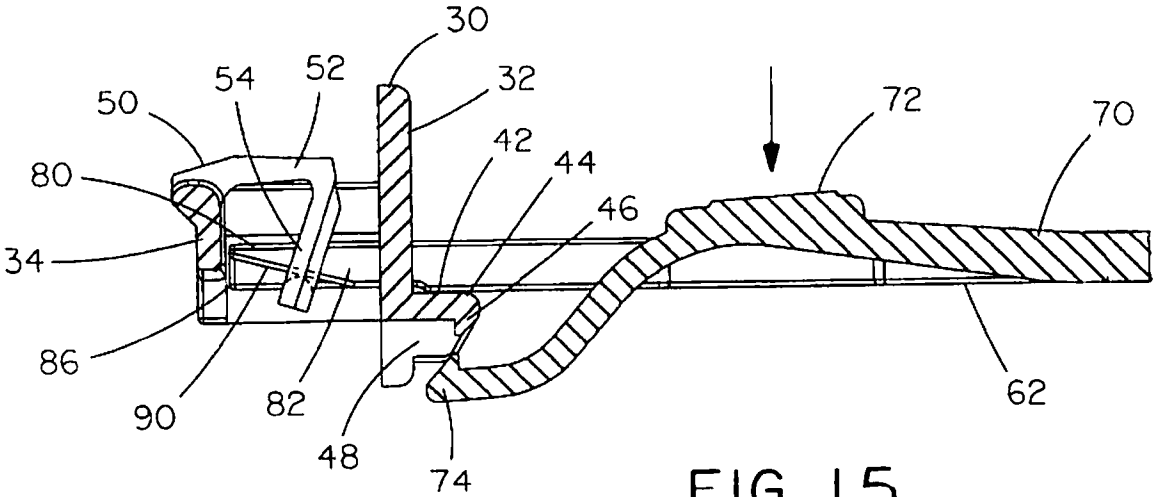
FIG. 15 illustrates a side view of the removal tool being disengaged from the block-out cover illustrated in FIG. 1.
Figure 16:
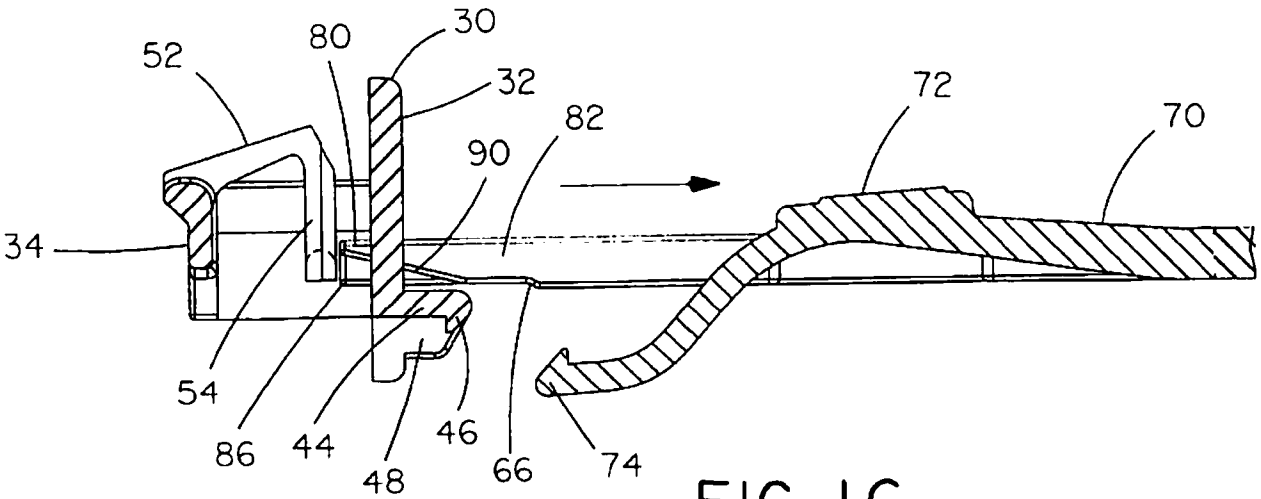
FIG. 16 illustrates a side view of the removal tool disengaged from the block-out cover illustrated in FIG. 1.

FIGS. 15 and 16 illustrate the removal tool 60 being removed from the block-out cover 30. As illustrated in FIG. 15, the release knob 72 of the lever 70 is depressed thereby lowering the hook 74 at the end of the lever 70. As a result, the hook 74 at the end of the lever 70 is no longer engaging the hook 46 extending from the connection member 42 of the cover 30. As shown in FIG. 16, once the hooks have been disengaged, the tool 60 may be pulled away from the block-out cover 30. As the tool 60 is pulled from the block-out cover 30, the arms 50 of the block-out cover 30 move forward and upward back to their initial position.

Figure 17:
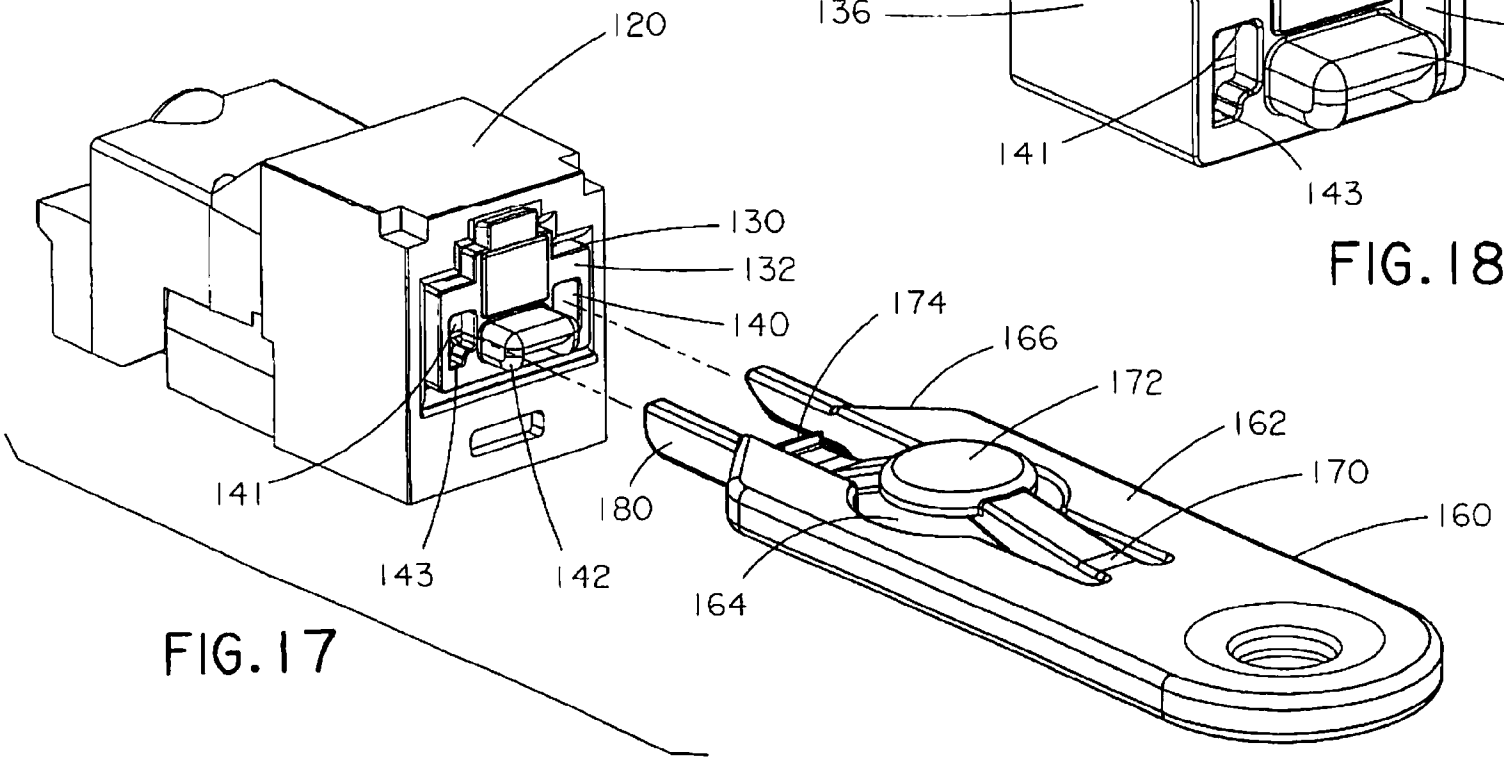
FIG. 17 illustrates a perspective view of an alternative design of the block-out cover installed in a jack module and a block-out removal tool of the present invention.
Figure 19:
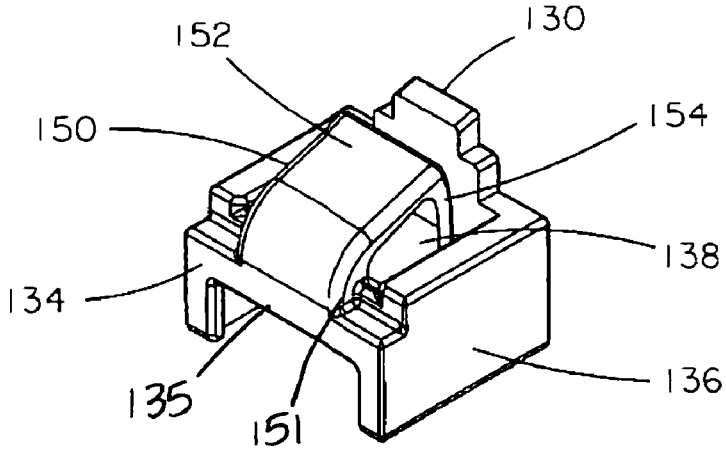
FIG. 19 illustrates a top rear perspective view of the block-out cover illustrated in FIG. 17.
Figure 20:
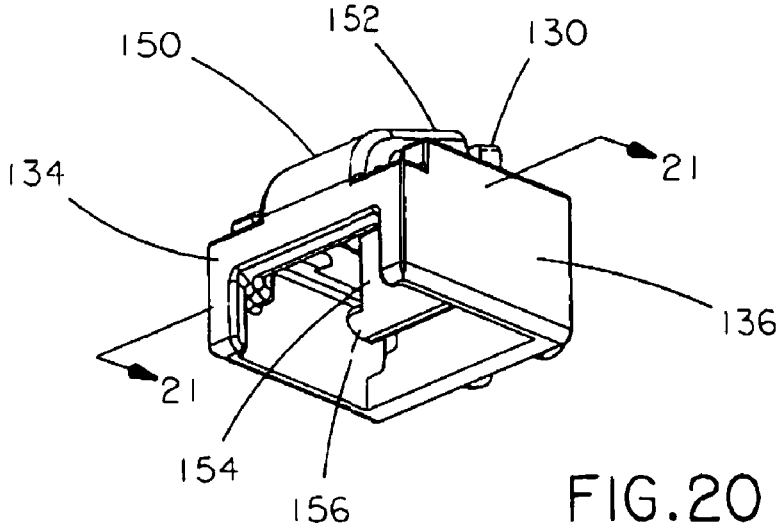
FIG. 20 illustrates a bottom rear perspective view of the block-out cover illustrated in FIG. 17.

FIGS. 17-29 illustrate an alternative design of the block-out cover and removal tool of the present invention. As illustrated in FIGS. 18-21, the block-out cover 130 includes a front 132, a back 134 and sides 136 that define an open section 138 therebetween. The front 132 of the alternative block-out cover 130 is shaped so that the block-out cover fits inside any standard RJ-45 data jack, as illustrated in FIG. 17.

Figure 18:
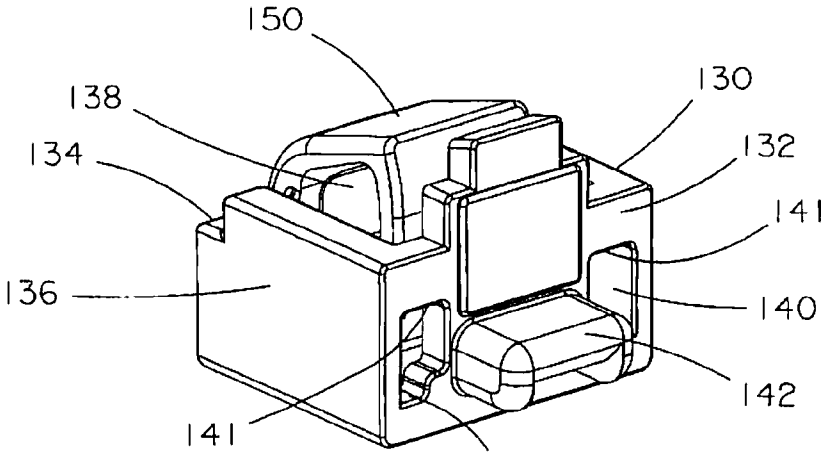
FIG. 18 illustrates a top front perspective view of the block-out cover illustrated in FIG. 17.

The front 132 of the block-out cover 130 includes two access windows 140, as shown in FIG. 18. The access windows 140 include a straight top portion 141 and a curved bottom portion 143. The shape of the access windows 140 restricts the insertion of the removal tool 160 so that the tool 160 may be inserted in the access windows 140 in only one specific orientation, as shown in FIGS. 17 and 25-29.

Figure 26:
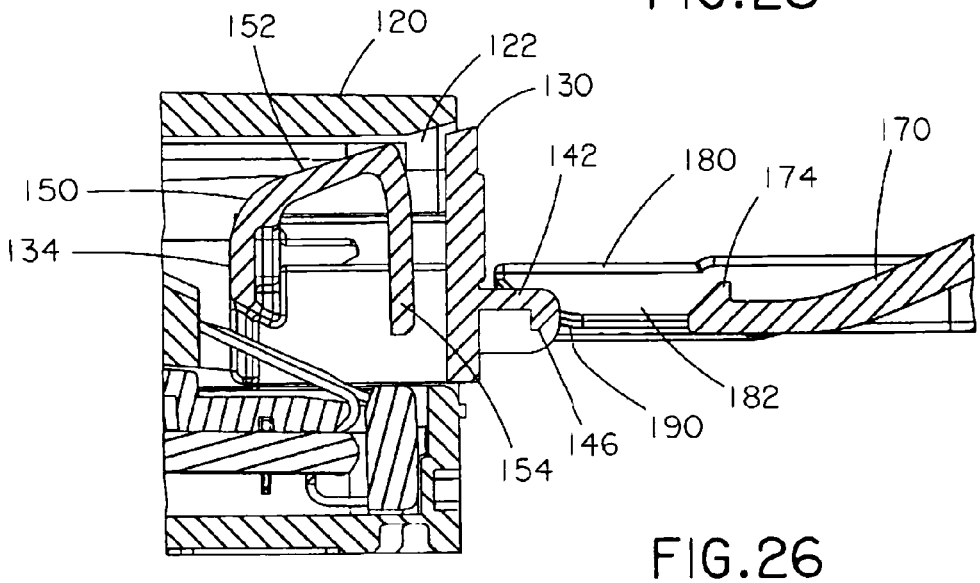
FIG. 26 illustrates a cross sectional view of the removal tool partially inserted in the block-out cover installed in the jack module taken along line 26-26 in FIG. 25.
Figure 27:
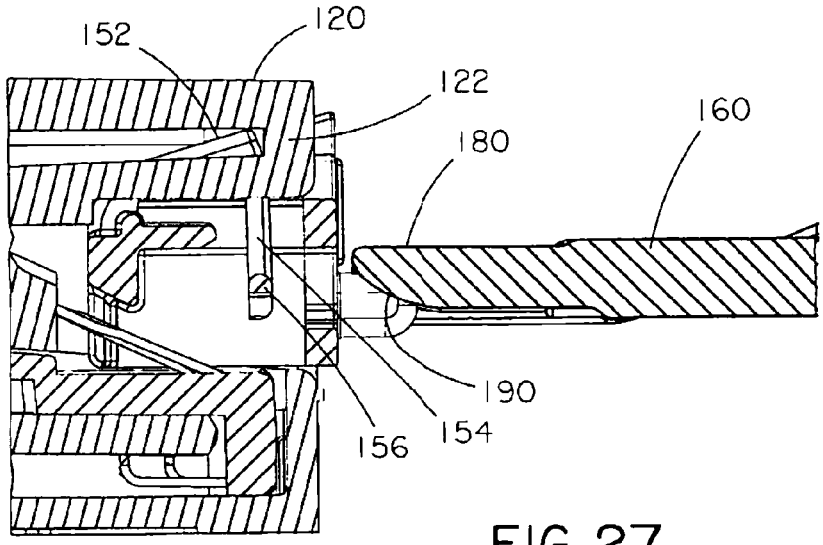
FIG. 27 illustrates a cross sectional view of the removal tool partially inserted in the block-out cover installed in the jack module taken along line 27-27 in FIG. 25.
Figure 28:
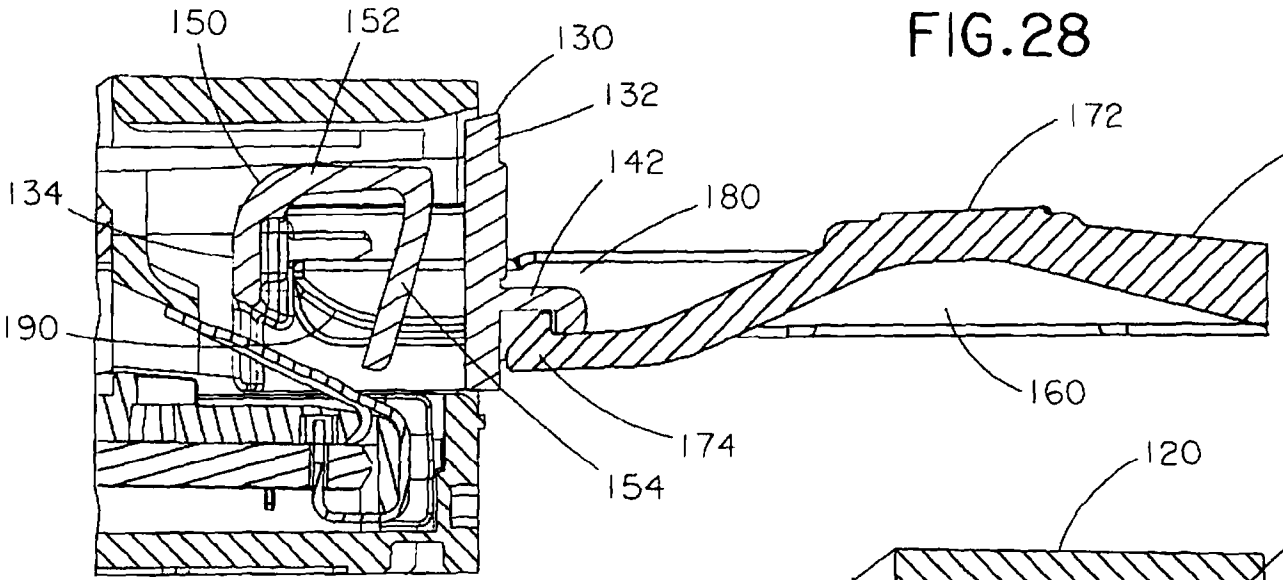
FIG. 28 illustrates a cross sectional view of the removal tool fully inserted in the block-out cover installed in the jack module illustrated in FIG. 26.
Figure 29:
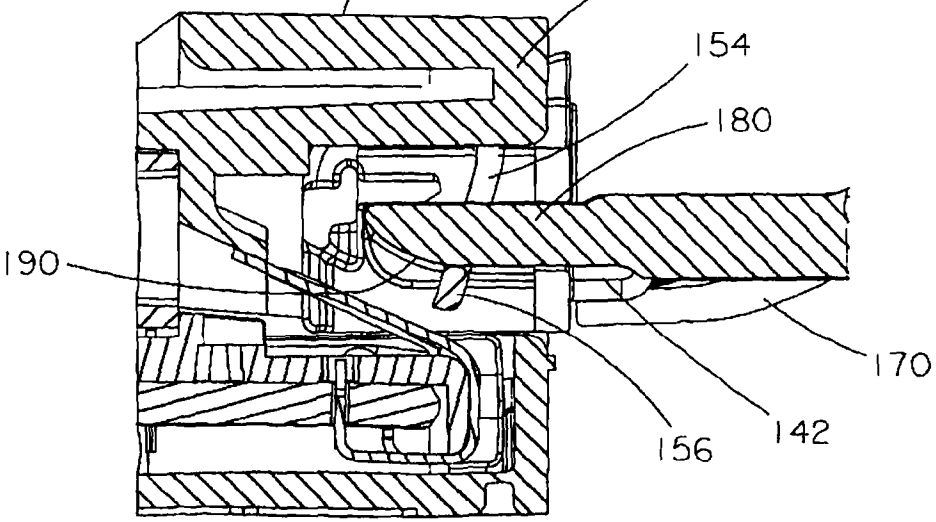
FIG. 29 illustrates a cross sectional view of the removal tool fully inserted in the block-out cover installed in the jack module illustrated in FIG. 27.

The front 132 of the block-out cover 130 also includes a connection member 142 that is positioned between the access windows 140 in the center of the block-out cover 130. The connection member 142 is integrally formed with the block-out cover 130. The connection member 142 includes a top portion 144 extending outwardly from the cover, a downwardly facing hook 146 and sides 148, as illustrated in FIG. 26. The hook 146 engages a hook 174 on the release lever 170 of the removal tool 160 to secure the removal tool 160 to the block-out cover 130.

Figure 21:
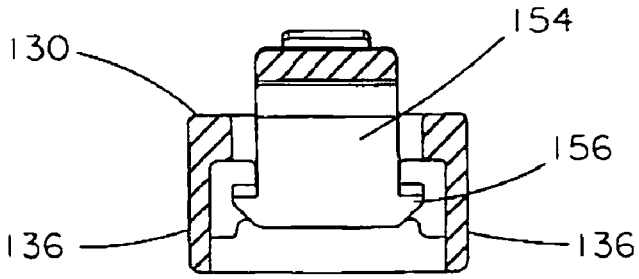
FIG. 21 illustrates a rear cross sectional view of the block-out cover taken along line 21-21 in FIG. 20.

The block-out cover 130 also includes a single piece locking arm 150 integrally formed with the block-out cover 130. The arm 150 extends from the back 134 of the cover 130 into the open center section 138 of the cover 130. The arm 150 includes first portion 151, second portion or an upwardly extending member 152 and third portion or a downwardly extending member 154. As shown in FIG. 26, a portion of back 134 and arm 150 may form a generally U-shaped profile. Back 134 may comprise bar member 135 connecting the opposing sides 136 of the cover 130, with an open space beneath bar member such that back 134 is open ended. Additionally, the upwardly extending member 152 of the arm 150 engages an upper shelf 122 in the jack module to secure the cover 130 to the jack module 120 (see FIGS. 26-27). The downwardly extending member 154 includes flanges 156 that extend outwardly from each side of the downwardly extending member 154. As shown in FIG. 21, the flanges 156 extend towards the sides 136 of the cover 130. As discussed below, the removal tool deflects the flanges 156 extending from the downwardly extending member 154 enabling the upwardly extending member 152 to become disengaged from the upper shelf 122 of the jack module 120.

Figure 22:
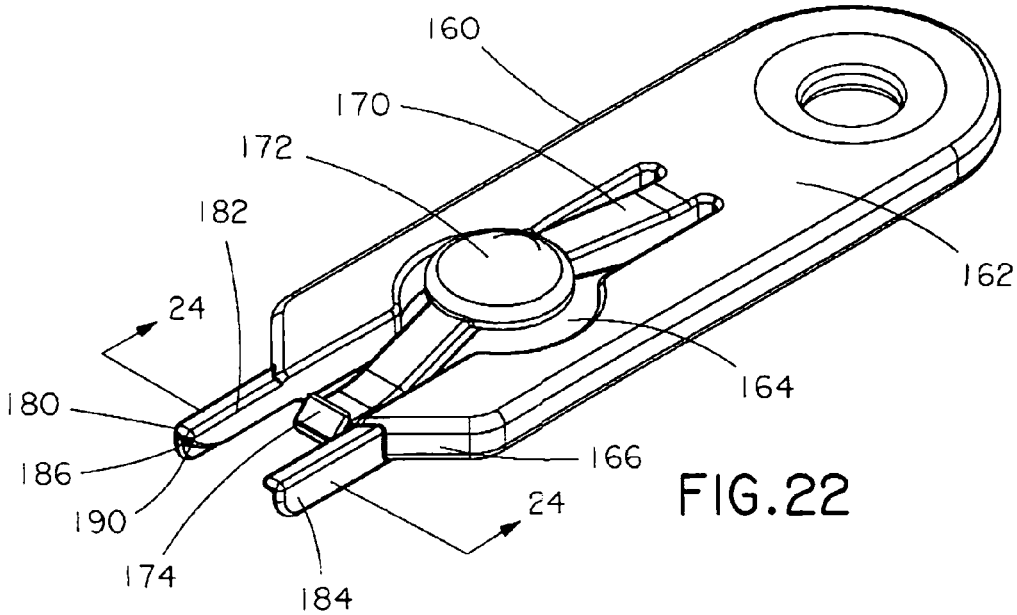
FIG. 22 illustrates a top perspective view of the removal tool illustrated in FIG. 17.
Figure 23:
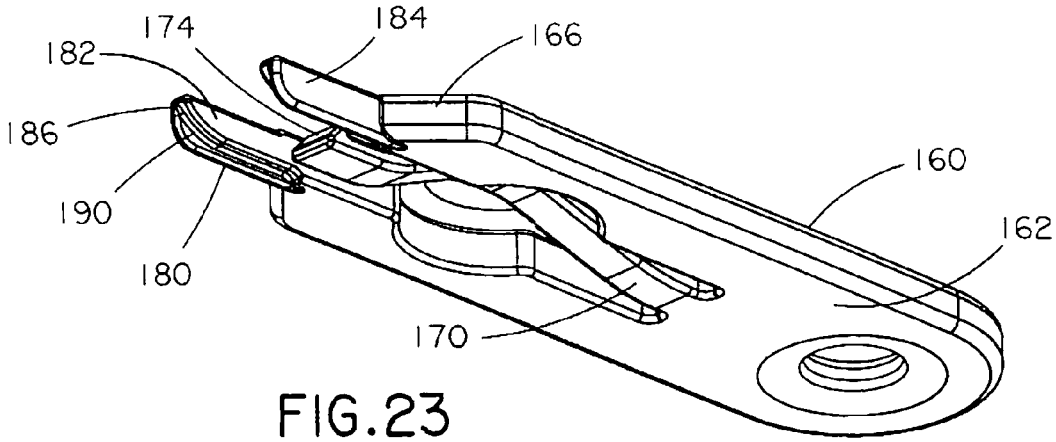
FIG. 23 illustrates a bottom perspective view of the removal tool illustrated in FIG. 17.
Figure 24:
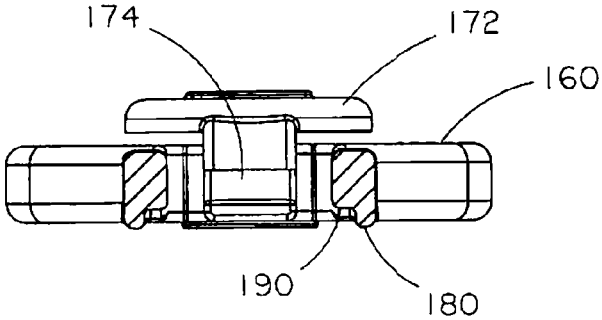
FIG. 24 illustrates a front cross sectional view of the removal tool taken along line 24-24 in FIG. 22.
Figure 25:
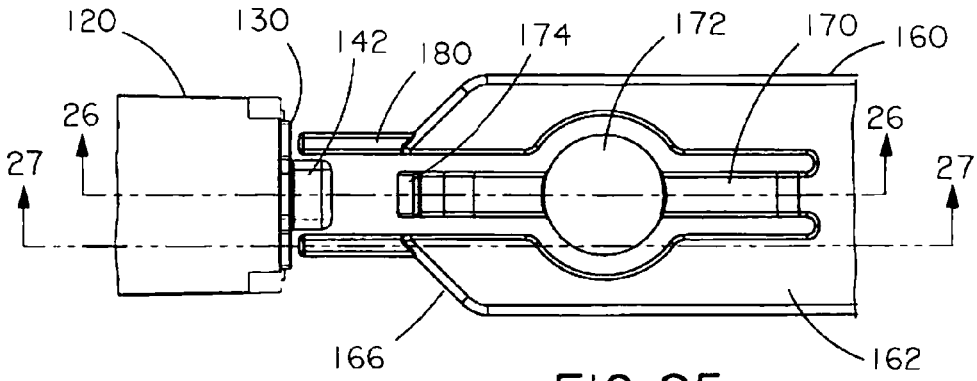
FIG. 25 illustrates a top plan view of the removal tool partially inserted in the block-out cover installed in the jack module illustrated in FIG. 17.

As illustrated in FIGS. 22-24, the removal tool 160 includes a body 162 with an opening 164 in the center of the removal tool 160 and an angled front edge 166. The removal tool 160 also includes a release lever 170 positioned within the opening 164 and prongs 180 that extend outwardly from the front edge 166 of the removal tool 160. The release lever 170 has a raised knob 172 located near the center of the lever 170 and an upwardly facing hook 174 located at the free end of the lever 170. The prongs 180 include an inner side 182, an outer side 184 and a front end 186. The inner side 182 of each prong 180 includes a curved cam 190 that extends from the front end 186 of each prong 180 downwards towards the front edge 166 of the tool 160. The curved cam 190 increases the vertical deflection of the arm 150 when the removal tool 160 is inserted in the block-out cover 130.

As illustrated in FIGS. 25-29, the prongs 180 of the removal tool 160 are aligned with the windows 140 in the block-out cover 130. As the prongs 180 of the removal tool 160 are inserted in the windows 140 of the block-out cover 130, the curved cam surface 190 of the prongs 180 engages the flanges 156 to deflect the arm 150 downward and back towards the back 134 of the block-out cover 130. As the prongs 180 deflect the arm 150, the upwardly extending member 152 of the arm 150 is disengaged from the upper shelf 122 in the jack module 120.

Additionally, as the removal tool 160 is inserted in the block-out cover 130, the hook 174 of the release lever 170 engages the hook 146 of the connection member 142 to secure the removal tool to the block-out cover. Once the arm 150 has been disengaged, the removal tool and the attached block-out cover 130 may be removed from the jack module 120. To remove the tool from the block-out cover, the release knob 172 of the lever 170 is depressed to lower the hook 174 at the end of the lever thereby disengaging the hook 146 of the connection member 142. Once the hooks are disengaged, the removal tool 160 maybe removed from the block-out cover 130.

Figure 32:
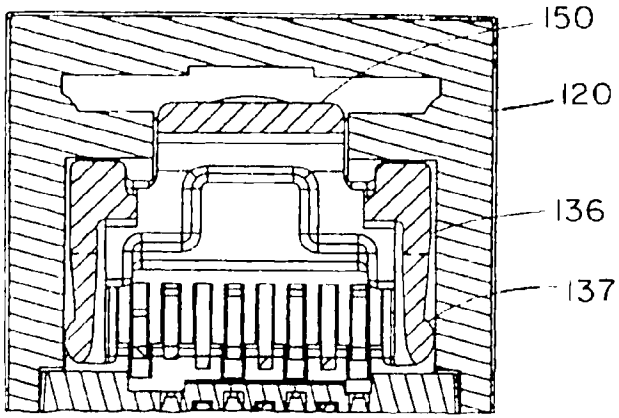
FIG. 32 illustrates a cross sectional view of the block-out cover installed in a jack module taken along line 32-32 in FIG. 31.
Figure 31:
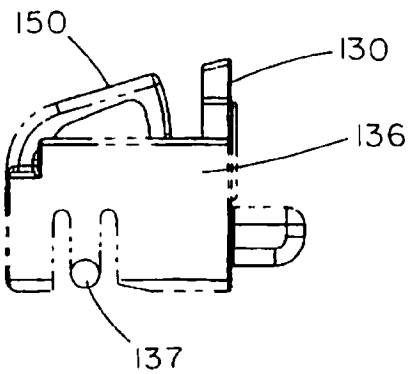
FIG. 31 illustrates a side view of the block-out cover of FIG. 30 installed in a jack module.
Figure 30:
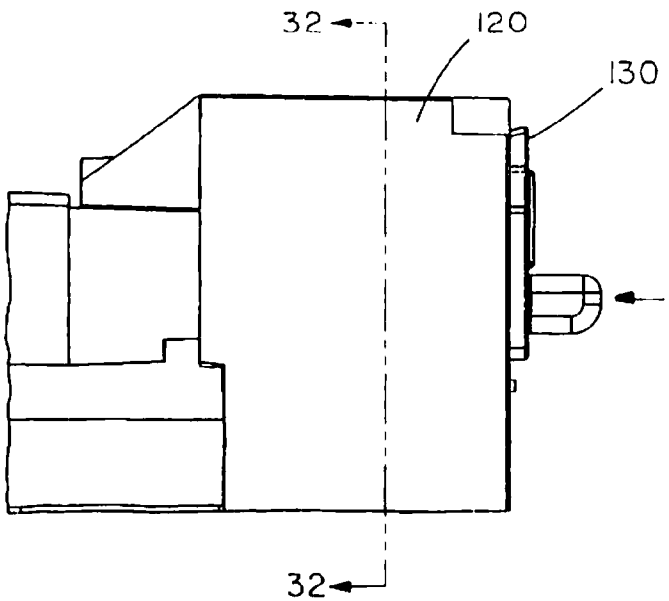
FIG. 30 illustrates a top front perspective view of the block-out cover of FIG. 17 with side spring tabs.
Figure 30:
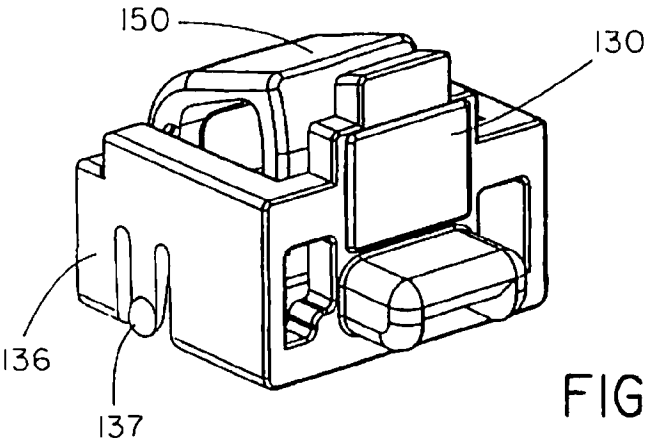

If desired, the block-out cover may include a spring tab 137 located at each side 136 of the cover (see FIGS. 30-32). The spring tabs 137 fill the gap between the block-out cover 130 and the jack module 120 when the block-out cover 130 is installed in the jack module 120. Thus, the spring tabs 137 provide a tighter fit between the block-out cover 130 and the jack module 120.

The removal tool and block-out cover of the present invention provide a safe and secure device for blocking jack modules. The block-out cover is designed so that it may only be removed with the two pronged removal tool of the present invention. As a result, the block-out tool would not accidentally or undesirably be removed by a screwdriver or other flat tool.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. A cover and removal tool combination for a jack, the combination comprising:

(a) a cover comprising:

a body comprising a front portion comprising an access window, opposing sidewalls connected to said front portion, a rear portion connected to said opposing sidewalls, with an open center defined between said front portion, said opposing sidewalls and said rear portion;

an arm extending from a central portion of said rear portion and positioned within said open center, said arm for engaging a shelf within said jack upon installation of said cover within said jack; and a flange extending from said arm and positioned closer to said access window than to said rear portion of the body, said flange for disengaging said cover from said jack; and (b) a removal tool comprising a longitudinally extending body terminating in a hook, said hook comprising a portion transverse to said longitudinally extending body and positioned to engage a portion of said cover after insertion into said access window, such that said removal tool is capable of being pulled in a direction along a longitudinal axis of said longitudinally extending body to remove said cover from said jack.

2. The combination of claim 1, wherein said front portion comprises forward and rearward facing surfaces, said arm spaced apart from said rearward facing surface of said front portion.

3. The combination of claim 1, wherein a portion of said arm is positioned at an obtuse angle relative to a surface of said rear portion from which said arm extends.

4. The combination of claim 1, wherein said arm comprises first, second and third portions and said first and third portions are substantially parallel and wherein said third portion is positioned closer to said front portion than said rear portion, has a greater length dimension than said first portion and terminates in a free end.

5. The combination of claim 1, wherein a portion of said rear portion and said arm form a generally U-shaped profile.

6. A cover and removal tool combination for a jack, the combination comprising:

(a) a cover comprising:

a body comprising a front portion comprising an access window, opposing sidewalls and a rear portion, defining an open center therebetween; and a single arm extending from a central portion of the rear portion and positioned within said open center, said single arm terminating in a free end, said free end positioned closer to said front portion of said body than said rear portion; and (b) a removal tool comprising a longitudinally extending body terminating in a hook, said hook comprising a portion transverse to said longitudinally extending body and positioned to engage a portion of said cover after insertion into said access window, such that said removal tool is capable of being pulled in a direction along a longitudinal axis of said longitudinally extending body to remove said cover from said jack.

7. The combination of claim 6, wherein said front portion comprises forward and rearward facing surfaces, said arm spaced apart from said rearward facing surface of said front portion.

8. The combination of claim 6, wherein a portion of said arm is positioned at an obtuse angle relative to a surface of said rear portion from which said arm extends.

9. The combination of claim 6, wherein said arm comprises first, second and third portions and said first and third portions are substantially parallel and wherein said third portion terminates in the free end, is positioned closer to said front portion than said rear portion and has a greater length dimension than said first portion.

10. The combination of claim 6, wherein a portion of said rear portion and said arm form a generally U-shaped profile.

11. The combination of claim 6, wherein said rear portion comprises a bar member connecting said opposing sidewalls, with an open space beneath said bar member, such that said rear portion is open ended.

12. A cover and removal tool combination for a jack, the combination comprising:

(a) a cover comprising:

a body comprising a front portion comprising an access window, opposing sidewalls connected to said front portion, a rear portion connected to said opposing sidewalls, with an open center defined between said front portion, said opposing sidewalls and said rear portion;

a single arm extending from a central portion of said rear portion and positioned within said open center, said single arm comprising first, second and third portions, wherein said third portion has a greater length dimension than said first portion, said second and third portions forming a shoulder for engaging a shelf within said jack upon installation of said cover within said jack and said third portion terminating in a free end; and a flange extending from said third portion and positioned closer to said access window than to said rear portion of said body, said flange for disengaging said cover from said jack; and (b) a removal tool comprising a hook for removing said cover from said jack.

13. The combination of claim 12, wherein a portion of said single arm is positioned at an obtuse angle relative to a surface of said rear portion from which said single arm extends.

14. The combination of claim 12, wherein said third portion comprises a length dimension substantially parallel to said opposing sidewalls that exceeds a length dimension of said first portion.

15. The combination of claim 12, wherein said front portion comprises forward and rearward facing surfaces, said arm spaced apart from said rearward facing surface of said front portion.

16. The combination of claim 12, wherein said hook of said removal tool extends from a longitudinally extending body, said hook comprising a portion transverse to said longitudinally extending body and positioned to engage a portion of said cover after insertion into said access window, such that said removal tool is capable of being pulled in a direction along a longitudinal axis of said longitudinally extending body to remove said cover from said jack.

* * * * *